United States Patent [19]

Egbers et al.

[11] Patent Number: 4,535,516

[45] Date of Patent: Aug. 20, 1985

[54] APPARATUS FOR THE PRODUCTION OF FIXED POINT MULTIFILAMENT YARNS

[75] Inventors: Gerhard Egbers, Reutlingen; Helmut Weinsdorfer, Pliezhausen, both of Fed. Rep. of Germany

[73] Assignee: Maschinenfabrik Rieter AG, Winterthur, Switzerland

[21] Appl. No.: 364,862

[22] PCT Filed: Aug. 13, 1981

[86] PCT No.: PCT/EP81/00123

§ 371 Date: Mar. 25, 1982

§ 102(e) Date: Mar. 25, 1982

[87] PCT Pub. No.: WO82/00668

PCT Pub. Date: Mar. 4, 1982

[30] Foreign Application Priority Data

Aug. 18, 1980 [AT] Austria ..... 4215/80

[51] Int. Cl.[3] ..... D02J 1/08; D02G 1/16

[52] U.S. Cl. ..... 28/272; 28/274

[58] Field of Search ..... 28/272, 274, 275, 276

[56] References Cited

U.S. PATENT DOCUMENTS

| | | | |
|---|---|---|---|
| 3,167,847 | 2/1965 | Gonsalves | 28/272 X |
| 3,237,269 | 3/1966 | Hawkins | 28/275 X |
| 3,262,179 | 7/1966 | Sparling | 28/274 |
| 3,605,397 | 9/1971 | Irwin et al. | 28/271 X |
| 3,750,242 | 8/1973 | Lloyd et al. | 28/276 |
| 3,824,656 | 7/1974 | Bauch | 28/255 |
| 3,958,310 | 5/1976 | Blanc et al. | 28/276 |
| 4,251,904 | 2/1981 | Sano et al. | 28/271 X |

FOREIGN PATENT DOCUMENTS

| | | | |
|---|---|---|---|
| 2813368 | 10/1978 | Fed. Rep. of Germany | 28/272 |
| 2840177 | 3/1980 | Fed. Rep. of Germany | 28/272 |
| 1155062 | 6/1969 | United Kingdom | 28/272 |

*Primary Examiner*—Robert R. Mackey

*Attorney, Agent, or Firm*—Kenyon & Kenyon

[57] ABSTRACT

Apparatus for the production of fixed point multifilament yarns with a whirling unit provided with a passage (15) through which the filaments to be whirled are driven and whirled together as at least one blasting nozzle injects gas into said passage. To obtain high filament feed rates and provide for the desired fixed points the blasting nozzle is in the form of a De Laval nozzle (20) whose jet is directed at an angle or perpendicularly to the longitudinal direction of the passage (15).

5 Claims, 16 Drawing Figures

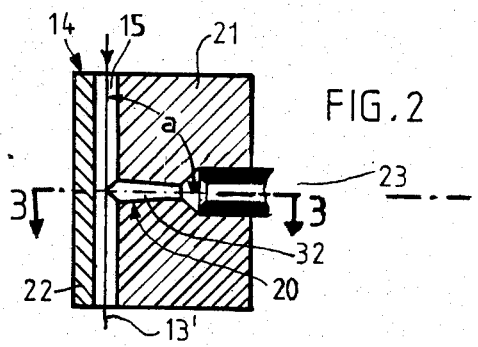
FIG. 2
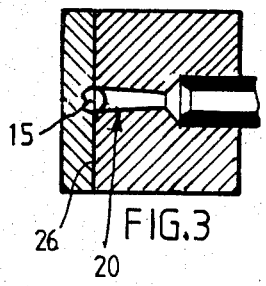
FIG. 3
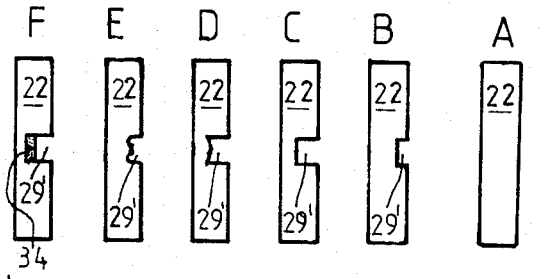
FIG. 5
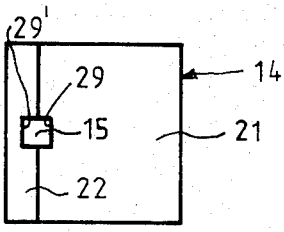
FIG. 6
FIG. 7B
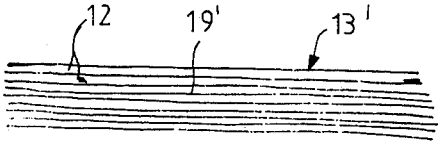
FIG. 7C
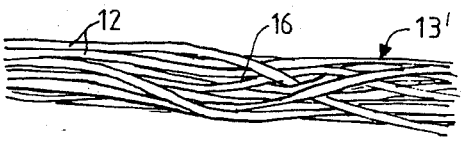
FIG. 7A
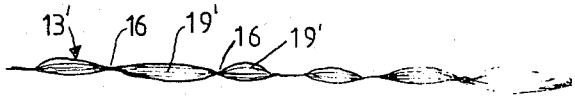

23
14
21
d2
d3
c2
d1
31
20
32
L
38
c1
29
15
26
29'
12
30
28
22

APPARATUS FOR THE PRODUCTION OF FIXED POINT MULTIFILAMENT YARNS

The invention relates to an apparatus for the interlacing of multifilament yarns to produce fixed point multifilament yarns and to a process for the operation of said apparatus.

The expression fixed point multifilament yarns refers to yarns consisting of a plurality of filaments which are entangled at more or less regular intervals at so-called fixed points (British: interlaces, entanglements), also frequently called "Knoten" (knots) in the German language, although they do not constitute knots. These fixed point-forming entanglements are produced by driving the filaments through a passage to prevent excessive lateral deviation thereof. In this passage, the filaments are exposed to at least one gas stream which entangles them to form the fixed points in the yarn, the filaments extending substantially parallel to each other between the fixed points.

The fixed points are used to provide the filaments of the multifilament yarn with a cohesion (fiber contact) sufficient for subsequent processing. A filament means a filament spun from a nozzle orifice (and also called "Fibrille" (fibril) in Switzerland, capillaries, elementary fibers, or endless fibers). This cohesion of the filaments of the multifilament yarn may be necessary for various reasons, for example to avoid the excessive spreading out of the filaments due to electrostatic charges, to avoid the splitting and damaging of the yarn by the guide teeth in weaving, or for different reasons especially to permit specific subsequent processing operations.

The filament materials may be the materials generally used in multifilament textile yarns (endless chemical yarns). They are the materials used in the production of endless synthetic fibers.

In Anglo-American linguistic usage endless synthetic fibers are now generally called filaments. The filaments may consist especially of uncrimped or possibly texturized (crimped) high molecular weight polymers (e.g. polyesters, polyamides, polyacryls, etc.), or of regenerated fiber materials (e.g. viscose, copper or acetate rayon). Other materials are also appropriate.

In known apparatus of this type (U.S. Pat. No. 2,985,995 and U.S. Pat. No. 4,069,565), filaments are driven through a circular straight passage of constant cross section of a whirling unit. One or more blasting nozzles open in the passage. The inner cross section of the nozzles is constant in the axial direction and the direction of blast is perpendicular to the median longitudinal axis of the passage. The maximum velocity of the air stream flowing out of such a blasting nozzle can reach the speed of sound, but only with a great consumption of air, which considerably increases the cost of producing fixed point multifilament yarns.

It is desirable to provide the multifilament yarn with a relatively high fixed point density (fixed point density=number of fixed points per meter of yarn length) of at least 20 fixed points/meter. In known apparatus, at medium to high filament feed rates, the fixed point density is inversely proportional to the filament feed rate. To increase the fixed point density, to date, a plurality of blasting nozzles has been provided in each passage, but the resulting fixed point density could not be substantially increased although the compressed air consumption had been considerably increased. Therefore, one object of the invention is to supply an apparatus of the above cited type which provides for the use of higher filament feed rates with the desired fixed point density and/or for a reduction in compressed gas consumption at given fimament feed rates.

Accordingly, it is an object of the invention to provide an interlacing apparatus which is capable of producing fixed point multifilament yarns in an efficient manner.

It is another object of the invention to produce fixed point multifilament yarns with high fixed point densities.

It is another object of the invention to be able to produce fixed point multifilament yarns using a gas stream in an infrasonic speed range.

Briefly, the invention provides an interlacing unit for an apparatus for the interlacing of multifilament yarns in order to produce fixed point multifilament yarns.

In one embodiment, the interlacing unit includes a pair of elements which define a longitudinal passage for guiding a multifilament yarn therethrough, which passage has a peripheral wall of predetermined length. In addition, the interlacing unit has a nozzle which extends through one of the elements and which has a converging inlet portion to receive a flow of gas and a diverging nozzle portion opening into the longitudinal passage opposite a portion of the wall of the passage in order to blow gas into the passage for interlacing of the multifilament yarn therein. This nozzle portion has an outlet from 0.2 to 0.5 times the peripheral length of the wall.

The nozzle which is used is a De Laval nozzle which is capable of emitting a jet which is directed at an angle or perpendicularly to the longitudinal axis of the passage through the interlacing unit.

Surprisingly, the apparatus provides for higher fixed point densities than the known apparatus of this type at high filament feed rates. For this purpose the gas stream flows out of the De Laval nozzle at supersonic speed. Consequently, especially high fixed point densities are obtained at high filament feed rates, so that the operation can be conducted at filament feed rates higher than before. The gas stream produced by the De Laval nozzle also provides for relatively high fixed point densities even in the infrasonic speed range, so that in many cases it is sufficient to operate the De Laval nozzles in the infrasonic speed range. De Laval nozzle feed pressures are relatively low even in supersonic speed range operations, so that in comparison to known apparatus the compressed air consumption of the apparatus of the invention is reduced even in supersonic speed operations. The compressed gas consumption is still lower when the De Laval nozzle is operated in the infrasonic speed range. The production costs for fixed point multifilament yarns are reduced regardless of whether the gas stream of the De Laval nozzle flows at supersonic or infrasonic speed. Although normally it is quite sufficient to associate the passage with only one De Laval nozzle, it is obviously possible to utilize several De Laval nozzles when it is desirable to obtain still higher fixed point densities or filament feed rates, or for various reasons, provided that the higher compressed air consumption is acceptable. However, generally, it is not necessary to provide the passage with several De Laval nozzles. On the contrary, it is normally quite sufficient and especially advantageous to associate only one De Laval nozzle with the passage of the interlacing or whirling unit. Then the compressed gas consumption is minimum. The compressed gas is advantageously air, but other gases can be used, preferably water vapor or possibly a gas acting physically and/or chemically on the multifilament yarn. An inert gas such as nitrogen can also be used.

Since the apparatus of the invention permits the use of filament feed rates higher than before with the fixed point densities under consideration, it can also be applied to processes which cannot be utilized successfully in known apparatus because of the high filament feed rates, for example in "rapid spinning", in which so-called POY yarns are produced. In this rapid spinning process, the filaments are preoriented immediately after the melt spinning operation, so that accordingly subsequent stretching can be limited.

The cohesion of the fixed points produced in multifilament yarn by the apparatus of the invention is very satisfactory, so that the fixed point multifilament yarn can be subjected to heavy stresses in subsequent processing operations.

The filaments of a single multifilament bundle entering the whirling unit can be whirled together, but it is also possible to introduce simultaneously into the passage a plurality of filaments or filament bundles coming from separate supply sources, and these filaments or bundles are united by the fixed points to form a single fixed point multifilament yarn. In some cases, it is not apparent that the resulting fixed point multifilament yarn has been formed by separately fed filaments or by one or more multifilament bundles. The introduction of a single multifilament bundle into the whirling unit is called in Germany by the British technical term "intermingling." The union by fixed points of several multifilament bundles to form a single fixed point multifilament yarn is called "comingling."

Another important advantage of the apparatus of the invention is that the filament passing through the whirling unit can be still under relatively high tension at high feed rates. This condition further extends the possibilities of application of the apparatus of the invention.

It has been found especially advantageous to split the gas stream generated by the De Laval nozzles at the passage wall surface towards which it is directed into two main spiral or whirling flows rotating in opposite directions. This is obtained simply with a De Laval nozzle producing a gas stream whose diameter at the point of entry into the passage is distinctly smaller than the diameter of the passage, so that the gas stream flows first between the filaments, and is then separated at the passage wall surface on which it impinges into two spiral flows rotating in opposite directions.

Apparatus of the invention can be integrated in machines or plants used to produce and/or process multifilament yarns, or be arranged in a machine used exclusively to produce fixed point multifilament yarns and advantageously comprising a plurality of such apparatus.

When the filaments are not separately fed, but one or more multifilament bundles are supplied to the whirling unit, the individual multifilament bundle is preferably nontwisted, i.e. the filaments thereof have no mutual cohesion resulting from twisting. It is possible also that a multifilament bundle entering the whirling unit should present such a light twist that the formation of fixed points of sufficient density is not prevented. Such twisted or nontwisted multifilament bundles are called also multifilament yarns.

The cross section of the whirling unit passage is preferably approximately constant along its length. However, in many cases, the passage cross section is appropriately varied along the length, and advantagously expanded continuously or by steps in the direction of feed of the filaments. Constrictions (baffles) and/or local expansions in the passage can be of small advantage in many cases. The passage is advantageously straight, or slightly curved in special cases.

To obtain high fixed point densities of the fixed point multifilament yarn, it has been found especially advantageous to provide for a ratio of 1:5 to 2:3 between the diameter of the narrowest cross section of the De Laval nozzle and the diameter of the whirling unit passage, measured perpendicularly to the median longitudinal axis of the De Laval nozzle.

The peripheral wall of the passage is preferably closed up to the inlet orifice or orifices for the gas stream or streams. It is conceivable, however, in many cases to provide the passage periphery with small air passage openings to influence the flow conditions in the passage.

To introduce the filaments from the side into the passage, the passage can be provided with lateral slots which can be closed during operation, a rotatable sleeve being used, for example, to open or close the slots.

Any suitable structure of the De Laval nozzle can be used. Advantageously, the portion thereof of expanding cross section in which supersonic speeds can develop can be of approximately conical shape. The angle of opening of this conical nozzle section of continuously expanding cross section can range suitably between 1° and 10°, preferably between 3° and 7°. Other configurations of the expanding portion of the De Laval nozzle are also possible. To obtain supersonic speeds in the De Laval nozzle, the compressed gas flowing through it must be first accelerated to the speed of sound by the reduced cross section, before it attains supersonic speed.

The De Laval nozzle can be set up so that its outlet orifice constitutes the inlet orifice in the peripheral passage wall for the gas stream which flows out of it. It is also conceivable in many cases to arrange the De Laval nozzle so that it injects the gas stream freely into the passage through a hole in the peripheral wall thereof. It is also conceivable in many cases to join the De Laval nozzle to the passage with a connection pipe.

The gas stream inflow orifice in the passage peripheral wall preferably extends along 0.2–0.5 times the periphery of said passage. The cross section of the gas stream flowing through this inlet orifice is suitably smaller than the cross section of said orifice.

Advantageously, the inner peripheral surface of the whirling unit passage may present a noncircular cylindrical shape since circular cross sections have been found less satisfactory, although in many cases circular cross sections can still provide for usable results. Shapes of the passage inner peripheral surface which have been found especially satisfactory are those which are capable of determining the splitting of the gas stream into two main spiral flows rotating in opposite directions. For this purpose, the peripheral half of the passage opposite the De Laval nozzle advantageously presents an approximately rectangular cross section or a central convex bulge towards which the medial longitudinal axis of the De Laval nozzle is oriented. The portion of the peripheral half of the passage provided with the gas stream inflow orifice is advantageously approximately semicircular or rectangular.

These and other objects and advantages of the invention will become more apparent from the following detailed description taken in conjunction with the accompanying drawings wherein:

FIG. 2 is a section through the whirling unit of the apparatus of FIG. 1.

FIG. 3 is a section through the whirling unit of FIG. 2, viewed along section line 3—3.

FIGS. 5A–5F represent modifications of the cover of the unit shown in FIGS. 1–4 and 6, in which the shapes of the peripheral half of the passage located away from the De Laval nozzle are different.

FIG. 6 is a bottom view of a whirling unit similar to that of FIGS. 1–4, but in which the cross section of the passage is rectangular.

FIG. 7A represents a length of a fixed point multifilament yarn carrying a heavy electrostatic charge, so that the filaments are spread out in the regions between the fixed points to provide for clear observation of the fixed points.

FIG. 7B represents a length of a fixed point multifilament yarn between two adjacent fixed points (not shown), the yarn carrying no electrostatic charge.

FIG. 7C represents one fixed point of a fixed point multifilament yarn which was drawn from a photomicrograph of a real fixed point.

Figure 1:
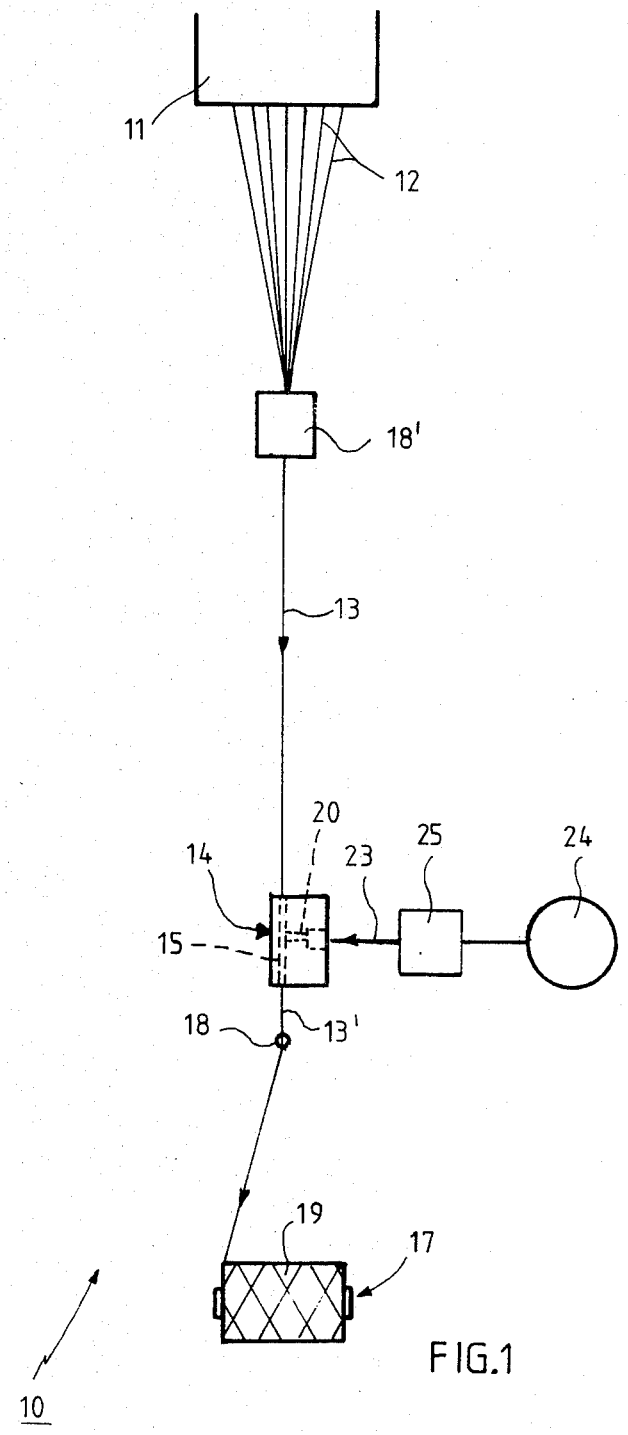
FIG. 1 is a schematic view of a rapid spinning apparatus with a whirling unit for the production of fixed points in a multifilament yarn.

Referring to FIG. 1, the rapid spinning apparatus comprises a melt spinneret 11, from which one single filament 12 is spun from each nozzle orifice of the spinneret 11. Filaments 12 pass through a preparation device 18′ in which a preparation (spin finish) is applied to counteract electrostatic charges and/or to improve the sliding properties, etc., and are united to form an untwisted multifilament bundle 13. This multifilament bundle 13 moves at a high feed rate to an interlacing (whirling unit) 14 and through its straight passage 15.

Multifilament bundle 13 is impinged upon by an air stream flowing advantageously at supersonic speed in the whirling unit 14, so that filaments 12 are whirled and form fixed points 16 (FIGS. 7A and 7C) separated by more or less irregular short distances. Then the resulting fixed point multifilament yarn 13′ passes through a thread guide 18 to a cross winder 17 to form a cross wound package 19. Before winding this fixed point multifilament yarn 13′ can be passed through at least one treatment station for subsequent processing, for example for stretching prior to winding.

Figure 4:
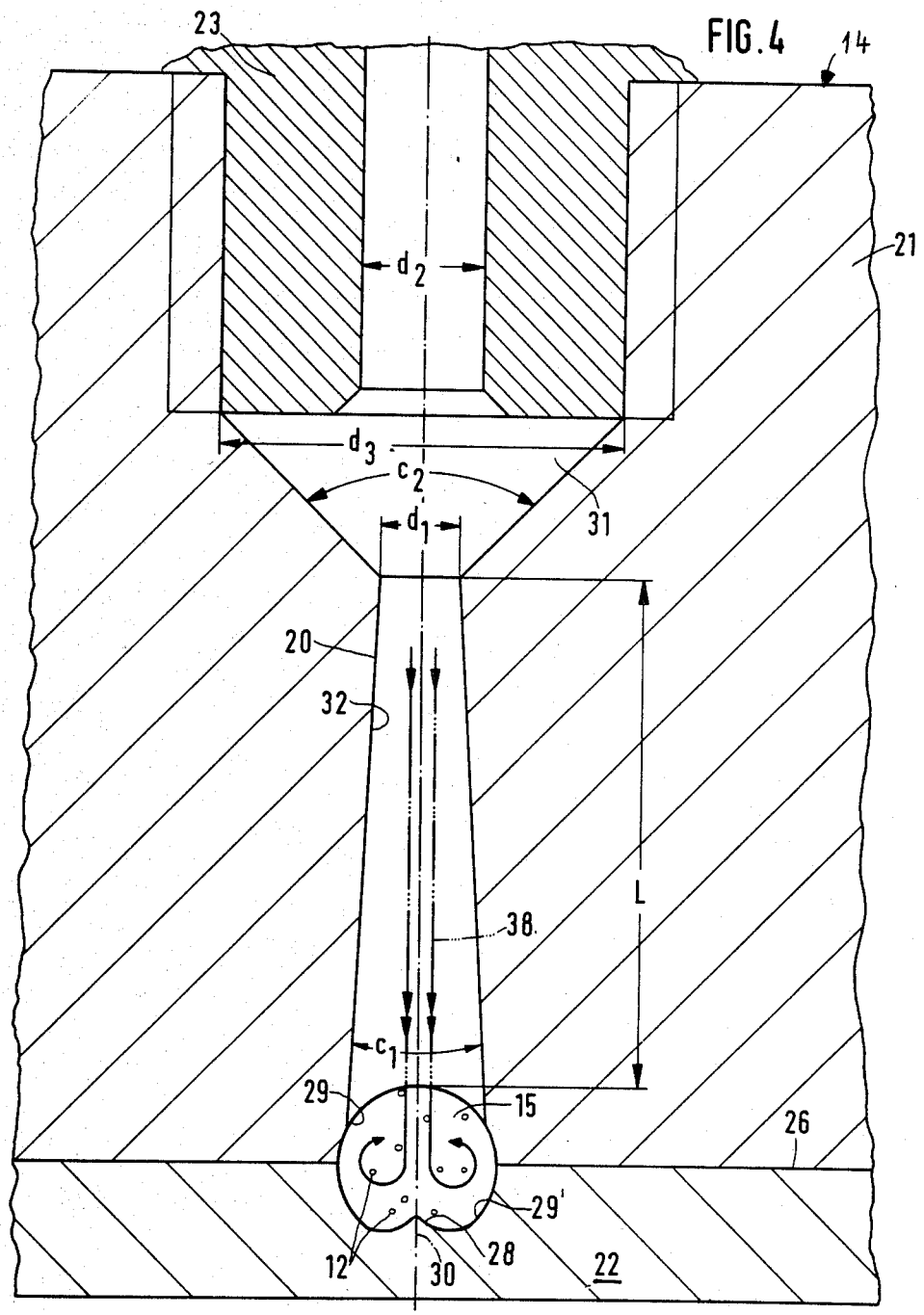
FIG. 4 shows a portion of FIG. 3 on a larger scale.

FIG. 7A represents a fixed point filament yarn 13′ carrying a heavy electrostatic charge and drawn as an original fixed point multifilament yarn produced by a whirling unit 14 as in FIGS. 2–4. Because of the heavy electrostatic charge the filaments 12 constituting the yarn are spread out in the intermediate regions 19′ between adjacent fixed points 16, so that it will be clearly observed that filaments 12 are not joined together in these intermediate regions 19′. In contrast the filaments are joined together at fixed points 16, and FIG. 7C represents an example of such a fixed point drawn from a photomicrograph. At such a fixed point filaments 12 form no loops (kinks), and no projecting loops, but simply cross in serpentine fashion at fixed points 16. As shown in FIG. 7B, on the contrary, filaments 12 are approximately parallel in each intermediate region between two adjacent fixed points, as in the case of an untwisted fixed point multifilament yarn 13′ when said yarn is not electrostatically charged. In intermediate region 19′ the thickness of the fixed point multifilament yarn 13′ is not different from the thickness of fixed points 16, so that frequently fixed points 16 are not visible except under the microscope.

The passage 15 of a brick shaped whirling unit 14 as in FIGS. 1–4 is cylindrical and presents a noncircular cross section as clearly visible in FIG. 4. A De Laval nozzle 20 opens into passage 15 approximately midway along its length. Unit 14 consists of two rigid one piece elements united by screws, specifically a principal component 21 containing De Laval nozzle 20 and a cover 22.

De Laval nozzle 20 is connected to a compressed air source 24 by a compressed air line 23 containing a pressure reducing valve 25. The feed pressure of De Laval nozzle 20 can be varied by pressure reducing valve 25.

The two substantially brick shaped components 21 and 22 of whirling unit 14 may be made of rigid metal and pressed together into sealing contact along a joint 26. One peripheral half of straight passage 15 is provided in each of said components 21 and 22, in the form of a straight groove 29, 29′ of constant cross section. Groove 29 in principal component 21 presents a semicircular cross section in this embodiment, and the cross section of the groove provided in cover 22 is substantially M-shaped. Passage 15, formed by the two grooves 29 and 29′, has a median longitudinal plane of symmetry 30 in which the median longitudinal axis lies, and passes centrally through a convex projection 28 extending in passage 15 of the M-shaped cross section peripheral half 29′ of passage 15, and also forms a median longitudinal plane of symmetry of De Laval nozzle 20.

In this embodiment, De Laval nozzle 20 presents a conical inlet portion 31 (angle of opening $c_2=118°$) whose inlet is connected to compressed air line 23 (inner diameter $d_2=2.7$ mm), and whose outlet is connected to a narrow conical nozzle portion 32 expanding slightly in the compressed air direction of flow and which opens here into the peripheral wall of passage 15. Inlet portion 31 is not shown on scale in FIG. 4. The largest diameter $d_3$ of inlet portion 31 is 8.4 mm. Nozzle portion 32 does not extend beyond the peripheral wall of passage 15, and its outlet extends approximately over 0.35 times the periphery of passage 15. During operation a supersonic flow in the form of a heavily bundled jet 38, whose diameter is distinctly smaller than the diameter of the outlet of continuously expanding nozzle portion 32, can be produced in portion 32.

The cross section of passage 15 is drawn to scale in FIG. 4, for an experimentally tested whirling unit 14. Its diameter in the plane of joint 26 was 3 mm. The angle of opening $c_1$ of the expanding nozzle portion 32 of De Laval nozzle 20 was about 6° in the experimentally tested apparatus of FIGS. 2–4. In these experimentally tested whirling units, the length L of expanding nozzle portion 32 was about 9 mm. The diameter of the circular inlet orifice of nozzle portion 32 was about 1.6 mm. In a *first experimental model,* the length of passage 15 was 35 mm, and in a *second experimental model* 25 mm, with the same De Laval nozzle 20.

In tests conducted with these two whirling units, the fixed point multifilament yarns produced consisted of 5–18 filaments, and each filament was of 3–4.4 dtex. It is understood tha multifilament yarns with different numbers of filaments and other titers can be whirled in this whirling unit 14. The filaments used in the cited tests were uncrimped, but other tests have shown that crimped filaments can also be provided with fixed points by the whirling unit of the invention. When crimped filaments are converted to fixed point multifilament yarns it may be necessary to provide passage 15 and De Laval nozzle 20 with slightly larger cross sections than in the case of uncrimped filaments.

Some test results obtained with the two above described whirling units of FIGS. 2–4 are given below. The introduced filaments were uncrimped and not twisted together, hence in each case uncrimped filament bundles were fed to the whirling unit and converted to fixed point multifilament yarns by the whirling unit.

1. Experimental Model with 35 mm-Long Passage 15

A 10-bar pressure compressor was used as compressed air source. Initially, this pressure was reduced to about 2–2.5 bars by pressure reducing valve 25, i.e. said pressure was the feed pressure for De Laval nozzle 20. But the resulting supersonic air flow broke multifilament bundle 13 and yarn 13'. Therefore the pressure of the compressed air flowing into De Laval nozzle 20 was decreased by reducing valve 25, and at a pressure of 1.1 bar the air jet of the De Laval nozzle flowed out at infrasonic speed and multifilament bundle 13 and yarn 13' were not damaged by the air flow, but good fixed point multifilament yarns 13' of relatively high fixed point density were formed. The multifilament yarn was exposed to a fiber tensile force of 8 cN in passage 15. For a feed rate of yarn 13' of 1,000 m/min an average fixed point density of 51 per meter was obtained. In comparative tests with a known, commercially available whirling unit without De Laval nozzle, but provided with a circular blasting nozzle of constant cross section along its length, only fixed point densities of 20 per meter could be obtained with a feed pressure of 1.5 bar, and of 41 per meter with a feed pressure of 3 bars, regardless of the high feed pressure and resulting high compressed air consumption, and further increases in the feed pressure did not provide for a substantial increase in the fixed point density. The tested multifilament yarns presented a total titer of 22 dtex and consisted of 7-filament polyamide 6,6.

2. Experimental Model with 25 mm-Long Passage 15

Although this experimental model differs from the above described experimental model only by the reduction of the length of passage 15 to 25 mm, De Laval nozzle 20 could be operated in the supersonic speed range without damaging the multifilament yarn by supplying the De Laval nozzle with higher feed pressures. Feed pressures of 1.5–4.5 bars providing for supersonic speeds were tested. At a filament feed rate of 1,500 m/min, highly satisfactory fixed point densities were obtained in comparison to those obtained with the known above cited whirling units, as appears from the table introduced at the end of the specification.

The fixed point densities were determined with the device developed by the applicants and known by the public as Reutlinger Interlace Counter.

The whirling unit of FIG. 2–4 was repeatedly modified in the experiments by substituting a cover 22 of different shape for cover 22, as shown in FIGS. 5A–5F. The cover 22 represented in FIG. 5A contains no groove, so that when it is applied to the principal component 21 provided with the groove of semicircular cross section of the unit of FIGS. 2–4, the resulting passage 15 presents a semicircular cross section with a flat bottom.

The covers 22 of FIGS. 5B, 5C, and 5F contain grooves 29' of rectangular cross section of different depth, so that the cross section of each passage produced with such a cover 22 and the principal component 21 of FIGS. 2–4 consists of two half cross sections, one of which is semicircular and the other rectangular. The covers 22 of FIGS. 5D and 5E contain grooves 29' whose bottom presents a convex crestlike projection; and the cross section of the groove 29' of FIG. 5E is similar to that of FIG. 4, with the difference that the side walls of groove 29' present flat parallel portions. In the groove 29' of FIG. 5D the M-shaped cross section is angular.

In some cases the multifilament yarn may produce considerable wear in the peripheral wall of passage 15, especially in the wall portion opposite De Laval nozzle 20. To reduce wear, a bottom plate 34 made of hard, abrasion resistant material, hard metal, or oxide ceramic material is inserted into groove 29' in the cover 22 of FIG. 5F. Cover 22 may also be made entirely of hard, abrasion resistant material, hard metal, or oxide ceramic material. Moreover, the principal component 21 of whirling unit 24 may be made, at least partially, of such highly abrasion resistant materials.

In the whirling unit 14 of FIG. 6, the cross section of the groove 29 forming one peripheral half of passage 15 in principal component 21 containing De Laval nozzle 20 is rectangular. The principal component 21 of FIG. 6 may also be combined with other covers, for example with the covers 22 of FIGS. 2 and 5A–5F.

The De Laval nozzle 20 of FIGS. 2–4 may be replaced by a De Laval nozzle of suitable different shape, advantageously by a De Laval nozzle whose initial portion extending to widening nozzle portion 32 tapers continuously downstream to portion 32, as is usually the case with known De Laval nozzles.

As represented in FIG. 4 by flow arrows, the highly bundled supersonic air jet 38 issuing from De Laval nozzle 20 can be split into two main spiral flows of approximately equal force rotating in opposite directions at the peripheral wall half of passage 15 opposite De Laval nozzle 20.

In the embodiments of FIGS. 1–4 and 6, the median longitudinal axis of De Laval nozzle 20 is approximately perpendicular to the straight median longitudinal axis of passage 15 intersected thereby, and the median longitudinal plane of De Laval nozzle 20 is also a median longitudinal plane of symmetry for passage 15. However, the two median longitudinal axes may conceivably be separated laterally by a short distance.

In the embodiments of FIGS. 2–4 and 6, the median longitudinal plane of symmetry 30 of De Laval nozzle 20 is substantially perpendicular to the median longitudinal axis of passage 15, so that the angle a indicated in FIG. 2 is of approximately 90°. It is also appropriate and advantageous in many cases to provide for an angle a smaller than 90°. Preferably, this angle may amount to 60°–90°. It is also conceivable in special cases to provide for an obtuse angle a, preferably when more than one De Laval nozzle opens into the passage. In this case angle a is larger than 90° for one of said De Laval nozzle, and approximately 90° or less than 90° for the other nozzle or nozzles.

Also, a passage 15 of relatively small diameter, preferably a few millimeters, may be appropriate. Such a passage prevents excessive lateral spreading out of the filaments, and is used also to direct the gas flow. Then it is preferably constructed so that it splits the flow at the point of injection into two main spiral flows rotating in opposite directions. Then, depending on the conditions of injections or the like, the two main spiral flows can stream out from the point of formation in equal or unequal fractions in the two axial directions of the passage, or possibly in only one axial direction.

Figure 8:
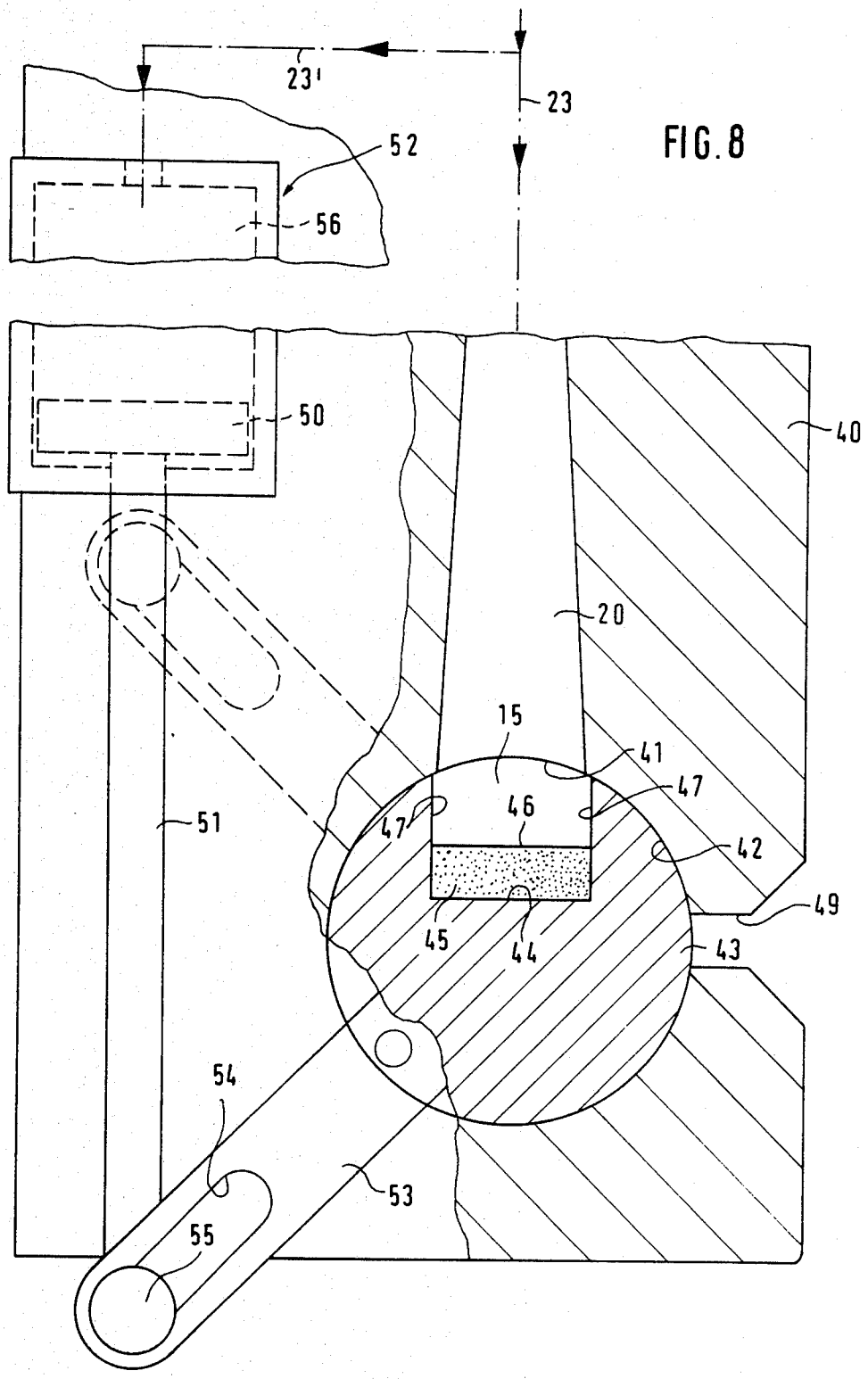
FIG. 8 is an incomplete view, partially in longitudinal section and broken away, of a whirling unit according to another embodiment of the invention.

In the embodiment of FIG. 8, an incorporated De Laval nozzle partly represented as in the embodiment of FIG. 4 is contained in the brick shaped principal component 40 shown incompletely and broken away, partially in section, of a whirling unit. The nozzle opens into a passage 15 through which a multifilament bundle is driven in whirling conditions to form a multifilament interlaced yarn, the outlet 41 of the nozzle being located approximately midway along the length of passage 15. Principal component 40 is pierced by a through bore 42 of circular cylindrical shape extending perpendicularly to the plane of the drawing. A rotating cylindrical element 43 in the form of a straight pin is rotatably mounted in the bore with very little sliding bearing play. This rotating element 43 is provided with a through longitudinal groove 44 in which a hard metal bar 45 of rectangular cross section is positively inserted to form a flat longitudinal rear wall 46 of passage 15. Therefore, the peripheral portion of passage 15 located in the rotating element 43 consists of the flat rear wall 46 thereof and of two flat parallel side walls 47 perpendicular to rear wall 46. The rest of the periphery of the passage is formed by the peripheral portion concerned of through bore 42 in which the outlet 41 of the De Laval nozzle is also located. A through lateral slot 49 is provided at an angle of 90° to the longitudinal axis of the De Laval nozzle in rigid principal component 40. The slot is used to introduce the multifilament bundle from outside into passage 15. For this purpose, rotating element 43 is turned clockwise from the fully extended position represented by about 90° to the angular position for which the portion of the passage located in the rotating element 43 is open opposite lateral slot 49, so that the multifilament bundle can be introduced from the side into passage 15. Passage 15 is returned to the operating position by turning back rotating element 43 by 90°. In this preferred embodiment, the return of rotating element 43 to the operating position can be effected by a cylinder 52 provided with a piston 50 and a piston rod 51 which pivots on a lever 53 arranged on one side of rotating element 43, using a drive member 55 which engages a slot 54 in lever 53. The operating chamber 56 of cylinder 52, which is single acting in this embodiment, is connected by a branch compressed air line 23' to the compressed air supply line 23 of De Laval nozzle 20 downstream of a check valve (not shown).

The operation is as follows. To introduce a multifilament bundle into passage 15, element 43 is rotated manually by lever 53 to the angular position providing for the introduction of the multifilament bundle. When the compressed air feed is opened from the side to De Laval nozzle 20, compressed air is also supplied to the chamber 56 of cylinder 52 to move piston 50 to the position shown. Therefore, rotating element 43 is moved automatically from the introducing position to the operating position on supply of compressed air to De Laval nozzle 20. As already described, during the operation, the air jet flowing out of the De Laval nozzle splits in passage 15 into two spiral flows rotating in opposite directions.

Figure 9:
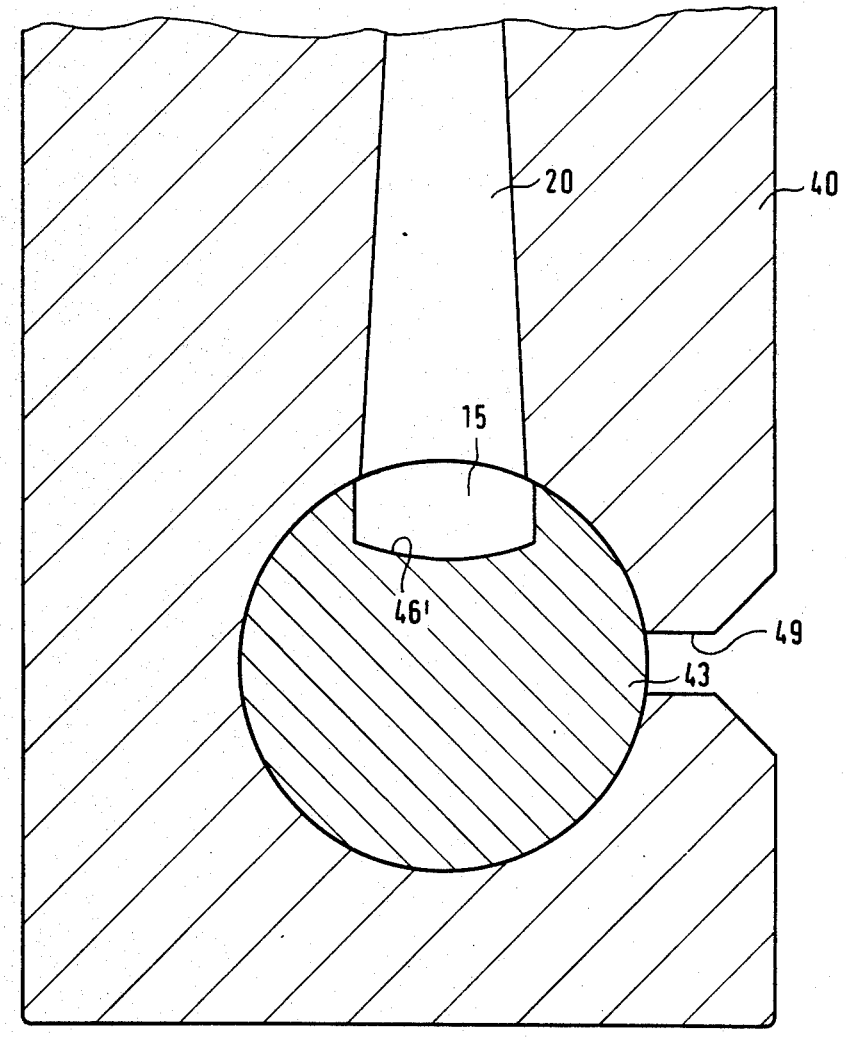
FIG. 9 is an incomplete section through a whirling unit according to another embodiment of the invention.

The whirling unit represented partially in section in FIG. 9 is similar to that of FIG. 8, but the means used to rotate element 43 are not represented. These means may be identical or similar to those contained in the arrangement of FIG. 8. In contrast to the arrangement of FIG. 8, the longitudinal rear wall 46' of passage 15 is not flat, but slightly concave. The angle of curvature of the cross sectional outline of the said rear wall 46' of passage 15 is larger than 3 mm, preferably much larger than 3 mm.

TABLE

| | F | 4 cN | | 8 cN | | 12 cN | | 16 cN | | | 20 cN | | |
|---|---|---|---|---|---|---|---|---|---|---|---|---|---|
| Fixed | P | 1.5 | 3 | 1.5 | 3 | 1.5 | 3 | 1.5 | 3 | 4.5 | 1.5 | 3 | 4.5 |
| point | A | 38 | 63 | 26 | 45 | 29 | 44 | 32 | 50 | 48 | 22 | 32 | 39 |
| densities | B | 30 | 35 | 15 | 34 | 24 | 23 | 15 | 28 | 20 | 17 | 23 | 31 |

22 dtex multifilament yarns with 7 filaments of polyamide 6,6
Filament feed rate 1,500 m/min
F = yarn tensile force in cN
P = nozzle feed pressure in bars
A = whirling unit as in FIG. 4 (but with $c_2$ = 118°) with 25 mm-long passage 15.
B = known whirling unit with circular cylindrical nozzle

We claim:

1. Apparatus for the interlacing of multifilament yarns to produce fixed point multifilament yarns, the apparatus comprising an interlacing unit having a bore, a rotatable body arranged in said bore, a longitudinal passage for accommodating multifilament yarns during treatment therein, said passage having a longitudinal direction with a first portion formed in said rotatable body and a second position formed by a wall portion of said bore, an elongate lateral slot intersecting said bore;

means for moving the multifilament yarns through said passage under tension at speeds in excess of 1000 meters per minute;

a pneumatic positioning motor for rotating said rotatable body to position said first portion of said passage in a threading position in alignment with said slot, whereby multifilament yarns can be inserted through said slot into said first portion of said passage and whereby said lateral slot is closed by said rotatable body on rotation of said rotatable body to an operating position in which said first portion of said passage is aligned with said second portion of said passage;

a blasting nozzle in the form of De Laval nozzle having a convergent section leading to a throat and a divergent section extending through said interlacing unit to open into said passage transversely to said longitudinal direction at an angle in the range of from 60° to 90° to said longitudinal direction, said divergent section having an opening at a junction with said passage extending peripherally of said passage in the range from 0.2 to 0.5 times the peripheral length of said passage;

gas source means for blowing gas under pressure into said De Laval nozzle to cause the gas to emerge in a stream through said opening into said passage at a desired speed to effect interlacing;

means for varying said gas pressure to select said desired speed;

a gas supply line extending from said means for varying said gas pressure to select said desired speed to said De Laval nozzle; and means for connecting said pneumatic positioning motor to said gas supply line whereby on supply of gas to said De Laval nozzle, said positioning motor is actuated to move said rotatable body from said threading position to said operating position.

2. Apparatus in accordance with claim 1 wherein said means for varying said gas pressure is adapted to select said desired speed to be a supersonic speed.

3. Appatatus in accordance with claim 1 wherein said means for varying said gas pressure is adapted to select said desired speed to be an infrasonic speed.

4. Apparatus in accordance with claim 1 wherein said divergent section of said De Laval nozzle diverges at an angle in the range of from 1° to 10°.

5. Apparatus in accordance with claim 1 wherein said divergent section of said De Laval nozzle diverges at an angle in the range from 3° to 7°.

* * * * *

UNITED STATES PATENT AND TRADEMARK OFFICE

CERTIFICATE OF CORRECTION

PATENT NO. : 4,535,516

DATED : August 20, 1985

INVENTOR(S) : Gerhard Egbers

It is certified that error appears in the above-identified patent and that said Letters Patent is hereby corrected as shown below:

Column 2, line 5 change "fimament" to -filament-

Column 5, line 51 change "winding this" to -winding, this-

Column 5, line 63 change "contrast the" to- contrast, the-

Column 5, line 66 change "point filaments to -points, filaments-

Column 6, line 12 change "section as" to -section, as-

Column 7, line 1 change "tha" to -that-

Signed and Sealed this

*Fourth* Day of *February 1986*

[SEAL]

*Attest:*

DONALD J. QUIGG

*Attesting Officer*

*Commissioner of Patents and Trademarks*